US010026543B2

(12) United States Patent
Kim et al.

(10) Patent No.: US 10,026,543 B2
(45) Date of Patent: Jul. 17, 2018

(54) COIL COMPONENT AND METHOD FOR MANUFACTURING THE SAME

(71) Applicant: SAMSUNG ELECTRO-MECHANICS CO., LTD., Suwon-si, Gyeonggi-do (KR)

(72) Inventors: Hyung Ho Kim, Suwon-si (KR); Jae Kwang Kim, Suwon-si (KR); Sang Ho Shin, Suwon-si (KR)

(73) Assignee: SAMSUNG ELECTRO-MECHANICS CO., LTD., Suwon-si, Gyeonggi-Do (KR)

( * ) Notice: Subject to any disclaimer, the term of this patent is extended or adjusted under 35 U.S.C. 154(b) by 0 days.

(21) Appl. No.: 15/072,942

(22) Filed: Mar. 17, 2016

(65) Prior Publication Data

US 2017/0084383 A1 Mar. 23, 2017

(30) Foreign Application Priority Data

Sep. 21, 2015 (KR) ..... 10-2015-0133224

(51) Int. Cl.

| | |
|---|---|
| ***H01F 27/29*** | (2006.01) |
| ***H01F 27/24*** | (2006.01) |
| ***H01F 27/255*** | (2006.01) |
| ***H01F 41/10*** | (2006.01) |
| ***H01F 17/04*** | (2006.01) |
| ***H01F 27/28*** | (2006.01) |

(52) U.S. Cl.

CPC ..... *H01F 27/29* (2013.01); *H01F 17/04* (2013.01); *H01F 27/255* (2013.01); *H01F 27/2828* (2013.01); *H01F 41/10* (2013.01)

(58) Field of Classification Search

CPC .... H01F 27/29; H01F 27/255; H01F 27/2823; H01F 27/24; H01F 41/06; H01F 41/10; H01F 3/08; H01F 17/045; H01F 2017/048

USPC ..... 336/212, 192, 233, 83

See application file for complete search history.

(56) References Cited

U.S. PATENT DOCUMENTS

| | | | | |
|---|---|---|---|---|
| 3,551,864 | A * | 12/1970 | Spoldi | H01F 27/02 336/178 |
| 4,245,207 | A * | 1/1981 | Murakami | H01F 17/045 336/136 |
| 6,351,203 | B1 * | 2/2002 | Mihara | H01F 17/045 336/192 |
| 6,717,500 | B2 * | 4/2004 | Girbachi | H01F 17/04 336/198 |
| 8,723,629 | B1 * | 5/2014 | Liu | H01F 27/29 336/192 |
| 2002/0158739 | A1 | 10/2002 | Shibata et al. | |
| 2004/0168303 | A1 * | 9/2004 | Matsumoto | H01F 3/10 29/607 |

(Continued)

FOREIGN PATENT DOCUMENTS

| | | |
|---|---|---|
| JP | 3305413 B2 | 7/2002 |
| JP | 2002-324714 A | 11/2002 |

(Continued)

*Primary Examiner* — Mangtin Lian

(74) *Attorney, Agent, or Firm* — McDermott Will & Emery LLP

(57) ABSTRACT

A coil component includes a core including a winding portion and a flange portion extending from a first end of the winding portion, a coil wound around the winding portion, a lead formed at the flange portion, and a cover coupled to the flange portion and covering at least a portion of the coil.

6 Claims, 5 Drawing Sheets

(56) References Cited

U.S. PATENT DOCUMENTS

| | | | | |
|---|---|---|---|---|
| 2010/0328003 | A1 | 12/2010 | Shibuya et al. | |
| 2012/0119859 | A1* | 5/2012 | Nishino | H01F 17/045 335/297 |
| 2015/0116070 | A1* | 4/2015 | Arai | H01F 17/045 336/192 |

FOREIGN PATENT DOCUMENTS

| | | | |
|---|---|---|---|
| JP | 3537635 | B2 | 6/2004 |
| JP | 2006-294775 | A | 10/2006 |
| JP | 2009-260116 | A | 11/2009 |
| KR | 10-2014-0038781 | A | 3/2014 |
| KR | 10-2015-0011163 | A | 1/2015 |

* cited by examiner

COIL COMPONENT AND METHOD FOR MANUFACTURING THE SAME

CROSS-REFERENCE TO RELATED APPLICATION

This application claims the benefit of priority to Korean Patent Application No. 10-2015-0133224, filed on Sep. 21, 2015 with the Korean Intellectual Property Office, the entirety of which is incorporated herein by reference.

TECHNICAL FIELD

The present disclosure relates to a coil component and a method for manufacturing the same.

BACKGROUND

As the number of electronic and communications devices has multiplied in recent years, there have been increasing numbers of communications faults, and the like, due to mutual interference caused by the frequent use of electronic and communications devices. To address such problems, regulations surrounding electromagnetic interference have been tightened in many countries around the world to improve electromagnetic environments in many locations, which have been worsened by the increasing use of wireless communications devices and multimedia devices. Following this trend, in recent years, electromagnetic interference shielding elements have been developed. Technologies allowing for compactness, a high degree of integration, and high efficiency have also been developed, with a concurrent increase in demand for parts used in electronic devices.

A power inductor used for such technologies may be classified as a multilayer type power inductor, a thin film type power inductor, and a wire-wound type power inductor, according to its structure and mechanism. Such multilayer type, thin film type, and wire-wound type power inductors may require different manufacturing methods and have different applications. In this regard, wire-wound inductors are generally manufactured by positioning a wound coil in a mold, filling magnetic powder particles, and then pressing and molding the magnetic powder particles.

SUMMARY

An aspect of the present disclosure provides a coil component having excellent product characteristics.

Another aspect of the present disclosure provides a method of manufacturing allowing a coil component to be easily mass produced.

According to an aspect of the present disclosure, a novel structure of a coil component having excellent product characteristics may be proposed. In detail, a new structure of a coil component having excellent product characteristics through a core, a coil, and a cover, being separately manufactured, in different processes, and assembling the respective core, coil, and the cover portions, may be proposed.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Figure 1:
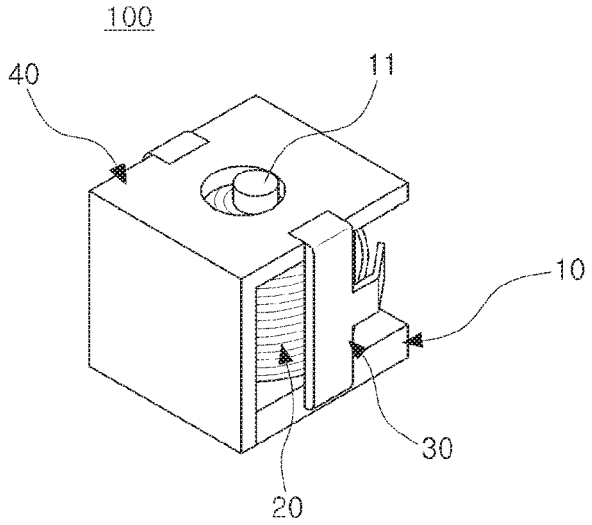
FIG. 1 is a perspective view of a coil component according to an exemplary embodiment.

Hereinafter, embodiments of the present inventive concept will be described as follows with reference to the attached drawings.

The present inventive concept may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

Throughout the specification, it will be understood that when an element, such as a layer, region or wafer (substrate), is referred to as being "on," "connected to," or "coupled to" another element, it can be directly "on," "connected to," or "coupled to" the other element or other elements intervening therebetween may be present. In contrast, when an element is referred to as being "directly on," "directly connected to," or "directly coupled to" another element, there may be no elements or layers intervening therebetween. Like numerals refer to like elements throughout. As used herein, the term "and/or" includes any and all combinations of one or more of the associated listed items.

It will be apparent that though the terms first, second, third, etc. may be used herein to describe various members, components, regions, layers and/or sections, these members, components, regions, layers and/or sections should not be limited by these terms. These terms are only used to distinguish one member, component, region, layer or section from another region, layer or section. Thus, a first member, component, region, layer or section discussed below could be termed a second member, component, region, layer or section without departing from the teachings of the exemplary embodiments.

Spatially relative terms, such as "above," "upper," "below," and "lower" and the like, may be used herein for ease of description to describe one element's relationship to another element(s) as shown in the figures. It will be understood that the spatially relative terms are intended to encompass different orientations of the device in use or operation in addition to the orientation depicted in the figures. For example, if the device in the figures is turned over, elements described as "above," or "upper" relative to other elements would then be oriented "below," or "lower" relative to the other elements or features. Thus, the term "above" can encompass both the above and below orientations depending on a particular direction of the figures. The device may be otherwise oriented (rotated 90 degrees or at other orientations) and the spatially relative descriptors used herein may be interpreted accordingly.

The terminology used herein is for describing particular embodiments only and is not intended to be limiting of the present inventive concept. As used herein, the singular forms "a," "an," and "the" are intended to include the plural forms as well, unless the context clearly indicates otherwise. It will be further understood that the terms "comprises," and/or "comprising" when used in this specification, specify the presence of stated features, integers, steps, operations, members, elements, and/or groups thereof, but do not preclude the presence or addition of one or more other features, integers, steps, operations, members, elements, and/or groups thereof.

Hereinafter, embodiments of the present inventive concept will be described with reference to schematic views illustrating embodiments of the present inventive concept. In the drawings, for example, due to manufacturing techniques and/or tolerances, modifications of the shape shown may be estimated. Thus, embodiments of the present inventive concept should not be construed as being limited to the particular shapes of regions shown herein, for example, to include a change in shape results in manufacturing. The following embodiments may also be constituted by one or a combination thereof.

The contents of the present inventive concept described below may have a variety of configurations and propose only a required configuration herein, but are not limited thereto.

Coil Component

Hereinafter, a coil component according to an exemplary embodiment in the present disclosure is described, and more particularly, a wire-wound inductor will be described as an example. However, the coil component according to the exemplary embodiment is not necessarily limited thereto.

Figure 2:
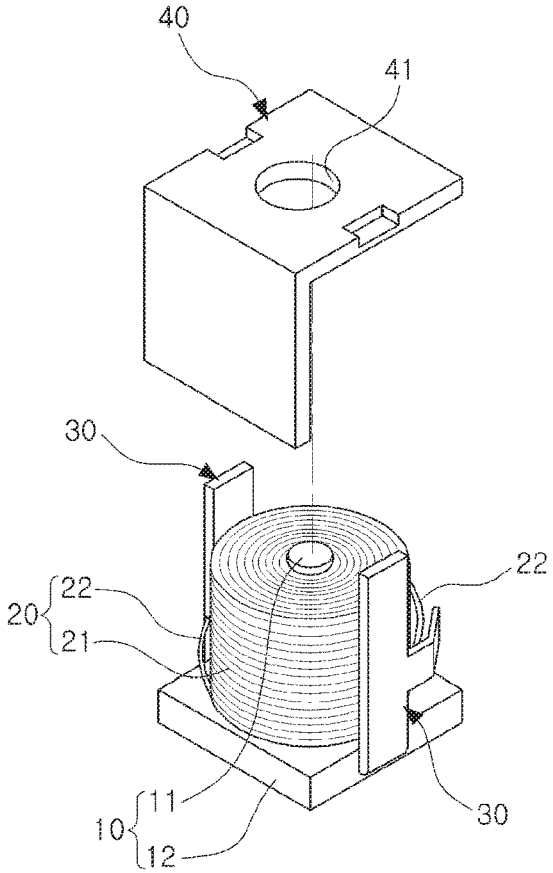
FIG. 2 is an exploded perspective view of the coil component of FIG. 1.

FIG. 1 is a perspective view of a coil component according to an exemplary embodiment and FIG. 2 is an exploded perspective view of the coil component of FIG. 1.

Referring to FIGS. 1 and 2, a coil component 100 according to an exemplary embodiment may include a core 10, a coil 20, a lead 30, and a cover 40.

The core 10 may include a winding portion 11 around which the coil 20 is wound and a flange portion 12 extending from one end part of the winding portion 11 to form a part of an outer surface of the coil component. In this case, a longitudinal cross section shape of the winding portion 11 is not particularly limited and therefore the winding portion 11 may have various known longitudinal cross section shapes such as circular, ovular, and quadrangular shapes. The winding portion 11 may be disposed to be perpendicular with respect to the flange portion 12.

The core 10 may include a magnetic material and may be formed of magnetic powder particles and thermosetting resins of epoxy, polyimide, or the like, interposed between the magnetic powder particles.

As a detailed example, the magnetic powder may be ferrite powder or metal magnetic powder showing magnetic properties. Further, the ferrite powder may include one or more selected from the group consisting of Mn—Zn-based ferrite powder, Ni—Zn-based ferrite powder, Ni—Zn—Cu-based ferrite powder, Mn—Mg-based ferrite powder, Ba-based ferrite powder, and Li-based ferrite powder and the metal magnetic powder may include one or more selected from the group consisting of Fe, Si, Cr, Al, Nb, P, B, C, Co, and Ni, but is not necessarily limited thereto.

The core 10 may be formed by filling the mold with the magnetic powder particles and then pressing and molding the magnetic powder particles.

As set forth above, the wire-wound inductor may be generally manufactured by positioning a wound coil in the mold, filling the magnetic powder particles, and then pressing and molding the magnetic powder particles. In this case, during the pressing and molding, an insulating layer of the coil may be stripped or the coil may be dislocated. As a result, it may be difficult to obtain desired characteristics (inductance, DC bias characteristics, or the like).

According to the exemplary embodiment, however, since the core 10 and the cover 40 are formed separately, a high pressure may be applied upon the pressing and molding. As a result, the fill factor of the magnetic material within the core 10 may be improved and the winding of the coils may be performed during each separation operation, preventing the insulating layer of the coil from being stripped and the coil from being dislocated, thereby easily implementing desired characteristics (inductance, DC bias characteristics, or the like).

The coil 20 may be formed of a metallic wire of copper (Cu), silver (Ag), or the like and may include a spiral portion 21 and at least one drawing portion 22 drawn from the spiral portion 21. As described below, the drawing portion 22 may be connected to a lead 30.

The coil 20 may not be limited to a single wire but may be formed of a twisted wire or two or more wires. Furthermore, the coil 20 is not limited to one having a circular cross section shape and therefore may also have various known cross section shapes such as a quadrangle.

The lead 30 may be connected to an external terminal to serve to receive an electrical signal and may be formed at the flange portion 12.

The lead 30 may be connected to the drawing portion 22 of the coil 20. According to an exemplary embodiment, the lead 30 may be connected to the drawing portion 22 by welding.

According to an exemplary embodiment, at least a part of the lead 30 may be embedded in the flange portion 12. As a result, it is possible to prevent the lead 30 from easily separating from the coil component 100.

According to an exemplary embodiment, the lead 30 may be bent to one side of the coil 20. As the lead 30 is bent to one side of the coil 20, an area of the coil component 100 may be considerably reduced.

According to an exemplary embodiment, the lead 30 may be bent to cover the cover 40 covering an upper portion of the coil 20 to be described below. As such, as the lead 30 is bent to cover the cover 40, the area of the coil component 100 may be considerably reduced and it is possible to prevent the cover 40 from easily separating from the coil component 100.

The cover 40 may serve to protect the coil 20 and may be coupled to the flange portion 12 and cover at least a portion of the coil 20.

A material of the cover 40 may not be particularly limited but to improve product characteristics by suppressing a leakage flux, the cover 40 may include a magnetic material and may be formed of magnetic powder particles and the thermosetting resins of epoxy, polyimide, or the like, interposed between the magnetic powder particles.

As a detailed example, the magnetic powder may be ferrite powder or metal magnetic powder showing magnetic properties. Further, the ferrite powder may include one or more selected from the group consisting of Mn—Zn-based ferrite powder, Ni—Zn-based ferrite powder, Ni—Zn—Cu-based ferrite powder, Mn—Mg-based ferrite powder, Ba-based ferrite powder, and Li-based ferrite powder and the metal magnetic powder may include one or more selected from the group consisting of Fe, Si, Cr, Al, Nb, P, B, C, Co, and Ni, but is not necessarily limited thereto.

Similar to the core 10, the cover 40 may be formed by filling the mold with the magnetic powder particles and then pressing and molding the magnetic powder particles.

According to an exemplary embodiment, the cover 40 may cover one side portion of the coil 20. Compared to the cover 40 covering both side portions of the coil 20, opposite to each other, the cover 40 covering one side portion of the coil 20 may be manufactured to a greater thickness, and as a result, mechanical strength of the coil component 100 may be more improved.

According to an exemplary embodiment, the cover 40 may cover one side portion and the upper portion of the coil 20. In this case, it is possible to further improve the mechanical strength of the coil component 100 and more easily protect the coil 20.

According to an exemplary embodiment, the cover covering the upper portion of the coil may be provided with an opening portion 41. In this case, the opening portion 41 may adhere to one end part of the winding portion 11 of the core 10.

Figure 3:
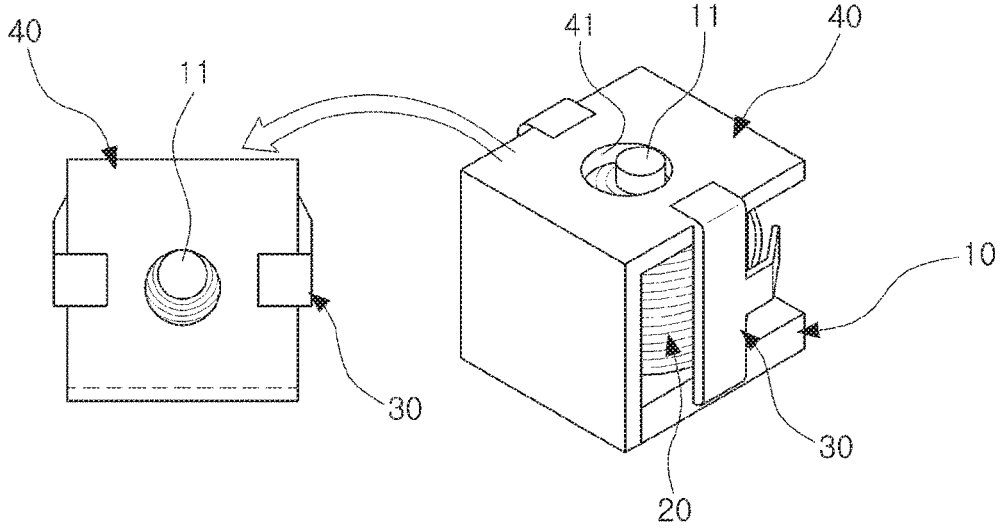
FIG. 3 is a diagram illustrating a positional relationship between an opening portion of an upper surface of a cover and a winding portion according to an exemplary embodiment.

FIG. 3 is a diagram illustrating a positional relationship between an opening portion of an upper surface of a cover 40 and a winding portion according to an exemplary embodiment.

Referring to FIG. 3, an area of the opening portion 41 may be larger than that of a longitudinal cross section of the winding portion 11 of the core 10. In this case, the core 10 may be easily coupled to the cover 40 to improve productivity.

Further, a center of the opening portion 41 and a center of the winding portion 11 may be spaced apart from each other. In this case, it is possible to prevent the cover 40 from easily separating from the coil component 100.

Method for Manufacturing Coil Component

Hereinafter, an example of a method for manufacturing a coil component having the foregoing structure will be described.

FIGS. 4A through 4E are diagrams sequentially illustrating a method for manufacturing a coil component according to an exemplary embodiment.

Figure 4A:
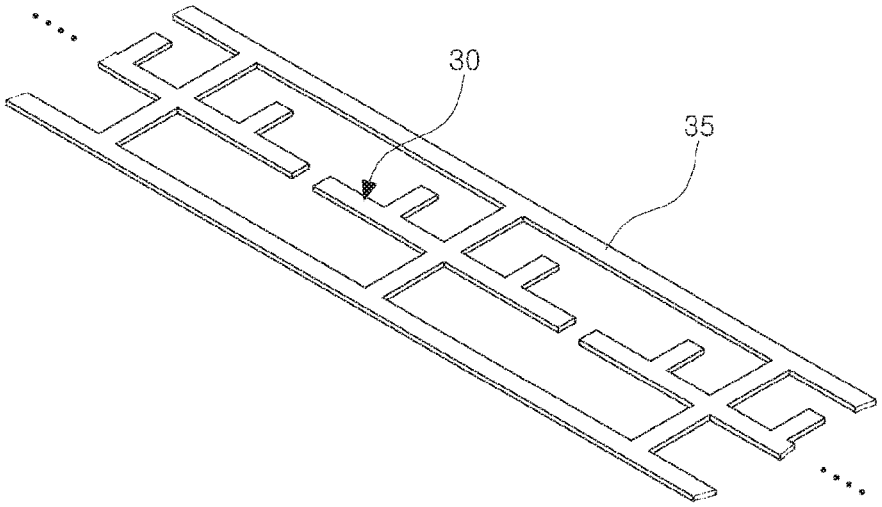
FIGS. 4A through 4F are diagrams sequentially illustrating a method for manufacturing a coil component according to an exemplary embodiment.

First, referring to FIG. 4A, a lead frame 35 including the lead 30 may be prepared.

The coil component having the foregoing structure is not necessarily manufactured using the lead frame 35. When the coil component is manufactured using the lead frame 35, however, vibration resistance and reliability of the coil component 100 may be improved, a large-sized coil component 100 may be easily manufactured, and the coil component 100 may be easily mass produced.

Meanwhile, FIG. 4A illustrates that the lead is integrally connected but the connection of the lead is not necessarily limited thereto. Therefore, the lead 30 may later be disconnected in a region embedded in the core 10.

Figure 4B:
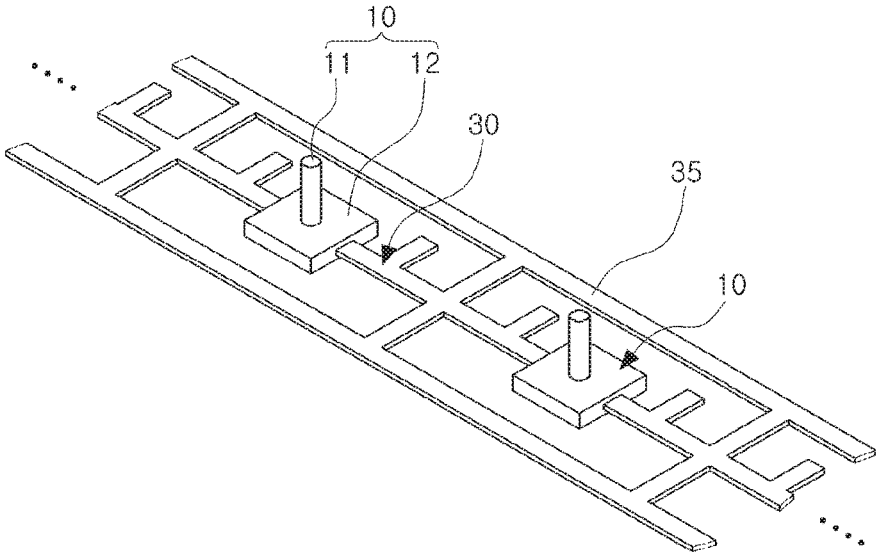

Next, referring to FIG. 4B, the core 10 including the winding portion 11 and the flange portion 12 extending from one end part of the winding portion 11 may be formed.

According to an exemplary embodiment, at least a part of the lead 30 may be embedded in the flange portion 12.

Further, according to an exemplary embodiment, the core 10 may be formed by positioning at least a part of the lead 30 in the mold, inserting the magnetic powder particles, and pressing and molding the magnetic powder particles, but the formation of the core 10 is not necessarily limited thereto.

Figure 4C:
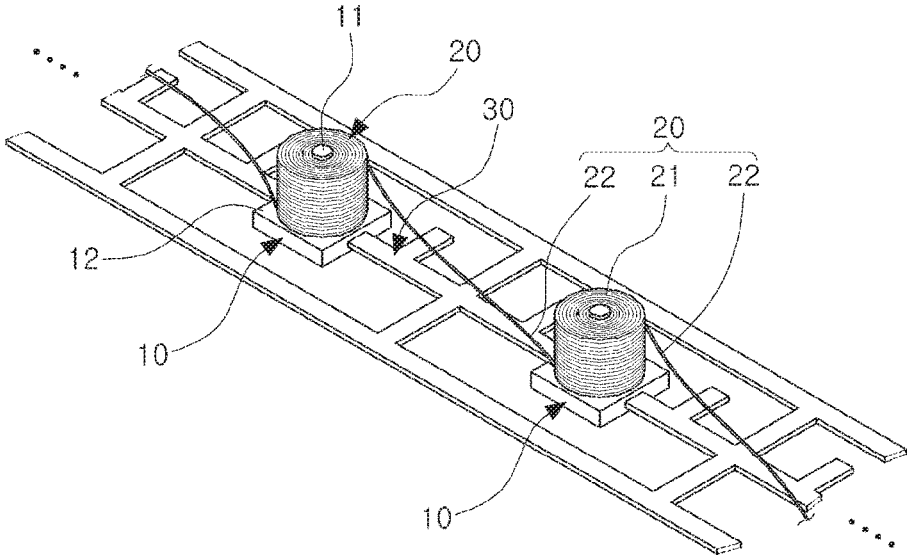

Next, referring to FIG. 4C, the coil 20 may be wound around the winding portion 11 of the core 10.

According to an exemplary embodiment, the coil 20 may have one or more drawing portion 22 and the drawing portion 22 may be coupled to the lead 30 by welding. The method for welding the drawing portion 22 to the lead 30 is not particularly limited. For example, the drawing portion 22 may be welded to the lead 30 by a resistance welding method but the welding of the drawing portion 22 to the lead 30 is not necessarily limited thereto.

Figure 4D:
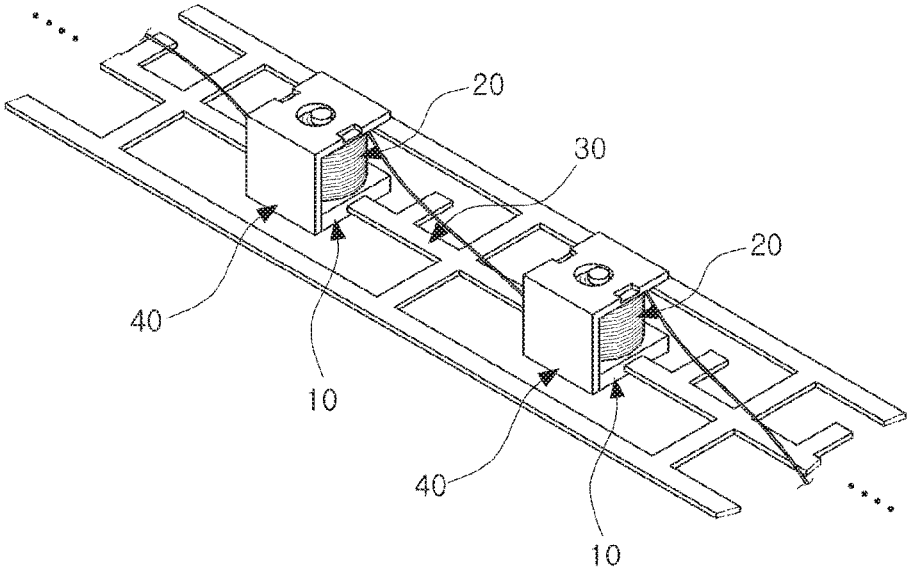

Next, referring to FIG. 4D, the cover 40 covering at least a part of the winding portion 11 of the core 10 may be coupled to the core 10.

In this case, the cover 40 may be manufactured by a separate process from that of the core 10. Similar to the core 10, the cover 40 may be formed by filling the mold with the magnetic powder particles and then pressing and molding the magnetic powder particles, but the formation of the cover 40 is not necessarily limited thereto.

Figure 4E:
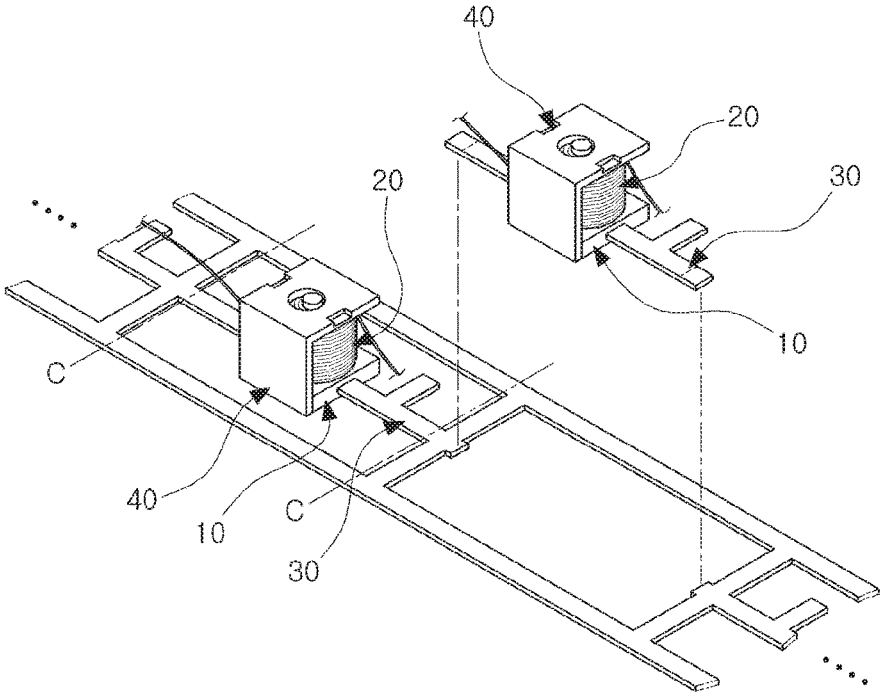
Figure 4F:
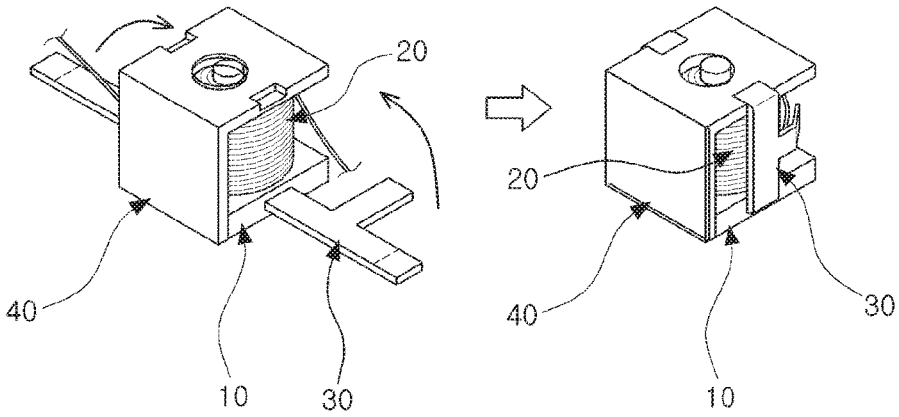

Next, referring to FIGS. 4E and 4F, the lead 30 may be cut from the lead frame 35 and then the exposed part of the lead 30 to the outside may be bent to cover the cover covering the upper portion of the coil, to thereby complete the manufacturing of the coil component 100.

A description of features overlapped with those of the coil component according to the exemplary embodiment described above except for the above-mentioned description will be omitted herein.

As set forth above, according to the exemplary embodiments, the coil component may have the excellent inductance and DC bias characteristics.

However, the various and useful advantages and effects of the present disclosure are not limited to the foregoing contents and may be more easily understood from the explanation of the detailed exemplary embodiments described above.

While exemplary embodiments have been shown and described above, it will be apparent to those skilled in the art that modifications and variations could be made without departing from the spirit and scope of the present disclosure as defined by the appended claims.

What is claimed is:

1. A coil component, comprising:

a core including a winding portion and a flange portion extending from a first end of the winding portion;

a coil wound around the winding portion;

a lead formed at the flange portion; and a cover coupled to the flange portion and covering at least a portion of the coil, wherein the cover covers one side portion and an upper portion of the coil, the portion of the cover covering the upper portion of the coil includes an opening, an area of the opening is greater than that of a longitudinal cross section of the winding portion, the opening is adhered to a second end opposite the first end of the winding portion such that the winding portion contacts the opening at a region of the opening opposite to the one side portion of the coil covered by the cover and does not contact a region of the opening adjacent to any side portion of the coil covered by the cover, at least a portion of the lead is embedded in the flange portion, the lead is bent to one side of the coil, and the lead is bent to cover the portion of the cover covering the upper portion of the coil.

2. The coil component of claim 1, wherein a center of the opening is spaced apart from a center of the winding portion.

3. The coil component of claim 1, wherein the coil has at least one drawing portion and the drawing portion is connected to the lead.

4. The coil component of claim 1, wherein the core includes magnetic powder particles and a thermosetting resin.

5. The coil component of claim 4, wherein the thermosetting resin is epoxy or polyimide.

6. The coil component of claim 1, wherein the winding portion is disposed to be perpendicular with respect to the flange portion.

* * * * *